United States Patent [19]

Davis

[11] Patent Number: 4,788,777

[45] Date of Patent: Dec. 6, 1988

[54] DRY KILN WOOD SPACING STICKER

[76] Inventor: Jeffrey E. Davis, 432 Roosevelt Ave., Redwood City, Calif. 94061

[21] Appl. No.: 131,603

[22] Filed: Dec. 11, 1987

[51] Int. Cl.[4] ..... F26B 25/00

[52] U.S. Cl. ..... 34/239; 34/38; 34/24

[58] Field of Search ..... 34/38, 24, 9.5, 13.8, 34/243 R, 237, 24, 239; 432/6; 201/40; 214/152

[56] References Cited

U.S. PATENT DOCUMENTS 4,199,870 4/1980 Arsenavlt ..... 34/38 X 4,663,860 5/1987 Beall ..... 34/38 X

*Primary Examiner*—Henry A. Bennet

*Attorney, Agent, or Firm*—Olson and Olson

[57] ABSTRACT

A sticker for spacing wood products apart vertically in a dry kiln is formed as an elongated, hollow, internally reinforced extruded rectangular profile of synthetic resin reinforced with glass fiber. The internal reinforcement is provided by one or more reinforcing webs that extend between the top and bottom peripheral walls of the rectangular profile. The preferred extrusion is made of a mixture of polycarbonate resin, polysulfone resin and 20–40% by weight glass fiber. The peripheral wall thickness of the rectangular profile ranges between about 0.0625 inch and 0.125 inch. The external width of the rectangular profile ranges between about 1 inch and 3 inches, preferably about 1.5 inches. The external height of the rectangular profile ranges between about 0.25 inch and 1.25 inches, preferably between about 0.625 inch and 1 inch. The length of the sticker ranges between about 4 feet and 9 feet.

9 Claims, 1 Drawing Sheet

DRY KILN WOOD SPACING STICKER

BACKGROUND OF THE INVENTION

This invention relates to dry kilns for drying lumber and other wood products, and more particularly to a novel sticker by which wood products are spaced apart vertically in a dry kiln for the circulation of heated air.

A "sticker" is a generic term for a spacer employed to separate layers of lumber in the kiln drying process. Its purpose is to allow hot air to flow uniformly between layers of lumber and allow moisture to escape from the wood. The rate of drying is critical and is controlled through the establishment of drying cycles which vary stepwise in temperature and time at each temperature. Drying cycles may very widely, depending upon the type of wood, with maximum temperatures ranging from around 160° F. for helmock to 260° F. or higher for southern pine.

Stickers are normally about 1.5 inches wide, from 0.625 inch to 1 inch thick and either 4 feet or 8–9 feet long. The length depends upon whether a crib or unit stacking technique is used. Stickers are laid perpendicularly across each layer of lumber by automatic sticking machines or by hand, with spaces between the stickers of about 2–3 feet. The number of stickers employed for a typical stack of lumber for dry kiln drying thus may total over 1,000. The total weight on the bottom layer of stickers can exceed 60,000 pounds, yielding compressive stresses exceeding 1,600 PSI.

It is a generally accepted practice to utilize wood material for stickers. These range from clean Douglas fir to seasoned hardwoods, or end cuts of plywood and 16-ply laminated Douglas fir. The primary limitations and disadvantages associated with wood stickers are that they are subject to breakage and warpage and they take a heat set over uneven layers. Wood also embrittles after heat aging and it compresses and gets thinner over time. Knots in wood present weak points which result in premature breakage.

The lifespan of wood stickers varies widely, depending upon the handling techniques, the wieghts supported by them, the drying temperatures and the type of wood used. It is the experience at some mills that the average lifespan is only 3–5 cycles of use, while others report 7–8 cycles. Some mills utilizing laminated stickers report as high as 10–15 cycles.

The cost of stickers also varies with the type of sticker. For a 4 foot sticker, current prices range from about \$0.15–\$0.25 and for 8 foot stickers from \$0.35–\$0.65, with laminated stickers costing about \$0.65–\$0.85 cents. Accordingly, the cost of stickers per cycle of use varies from about \$0.03–\$0.10, depending upon the type of sticker and the particular lumber mill utilizing them.

Other forms of lumber spacing stickers have been proposed heretofore. Among these are the solid, resin-impregnated paper laminate sticker described in U.S. Pat. No. 3,900,957; the wire mesh stickers and cooperating wood stickers described in U.S. Pat. No. 4,199,870; and the sticker frames described in U.S. Pat. No. 4,663,860. All of these are characterized by excessive cost and complication of manufacture, use and storage. Moreover, like wood stickers, they cannot be repaired or reprocessed when broken.

SUMMARY OF THE INVENITON

This invention provides a dry kiln wood spacing sticker which is produced by the extrusion of a glass fiber-reinforced synthetic resin to form an elongated, hollow, internally reinforced sticker of light weight and high compressive strength.

It is the principal objective of this invention to provide a sticker of the class described that overcomes the aforementioned limitations and disadvantages of prior stickers.

Another objective of this invention is to provide a sticker of the class described that retains its dimensional stability and integrity over a long service life.

A still further objective of this invention is the provision of a sticker of the class described that is characterized by high heat and creep resistance up to 260° F., is capable of withstanding high compressive and sheer stresses at 260° F., and possesses high impact resistance.

A further objective of this invention is to provide a sticker of the class described that is comparable in weight and surface roughness to wood stickers and is capable of manipulation with speed and facility either manually or by automatic sticking machines.

A still further objective of this invention is to provide a sticker of the class described that is capable of being manufactured in large numbers at low cost.

The foregoing and other objects and advantages of this invention will appear from the following detailed description, taken in connection with the accompanying drawings of preferred embodiments.

DESCRIPTION OF THE PREFERRED EMBODIMENTS

Figure 1:
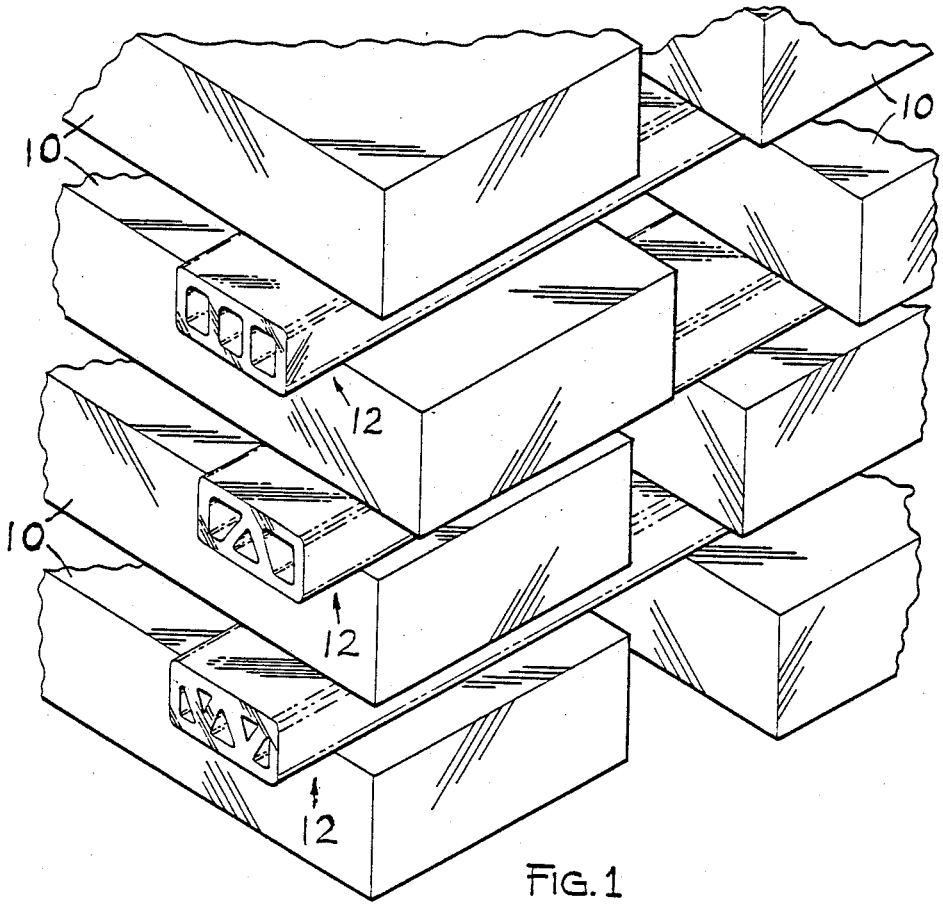
FIG. 1 is a fragmentary perspective view of a stack of lumber the layers of which are spaced apart vertically by a plurality of stickers embodying the features of this invention.

FIG. 1 illustrates a plurality of lumber products 10 spaced apart laterally and supported in vertically spaced layers by a plurality of laterally and vertically spaced stickers 12 of this invention.

The sticker of this invention is an elongated hollow, internally reinforced extruded rectangular profile of glass fiber-reinforced synthetic resin capable of supporting a plurality of vertically spaced layers of wood products forming a vertical stack of the usual dimensions to fill a conventional dry kiln.

For example, a typical stack of wet lumber is about 15 feet high. Thus, it can impose a total weight on the lowermost stickers in excess of 60,000 pounds.

Although there are many synthetic resins suitable for the purpose of this invention, a preferred thermoplastic resin is polycarbonate, available commercially from a variety of sources, such as General Electric's Lexan. The temperature resistance of the resin may be increased by admixture with it of 25–50% by weight polysulfone resin, such as Union Carbide's Udel.

The glass fiber content of the extrusion material may range between 20–40% by weight to provide the desired rigidity, compressive strength, creep resistance and a desired rough surface which inhibits the slippage of wood product engaging the stickers. Less than about 20% by weight glass fiber contributes insufficient strength, while greater than about 40% by weight renders the mixture difficult to extrude.

Other additives, such as carbon black or other type of ultraviolet absorber, and coloring dyes or pigments, also may be incorporated in the extrusion mixture. These may constitute up to about 1% by weight of the mixture, preferably not more than about 0.2% by weight.

The hollow sticker of this invention may range in width from about 1 inch to about 3 inches, preferably about 1.5 inches, and may range in height between about 0.25 inch and 1.25 inches, preferably between about 0.625 inch and 1 inch. The peripheral wall thickness may range between about 0.0625 inch and 0.125 inch. As previously mentioned, the stickers may range in length between about 4 feet and about 9 feet.

Figure 2:
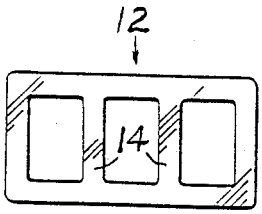
FIGS. 2, 3 and 4 are end views showing stickers of this invention with different forms of internal structural reinforcements.
Figure 3:
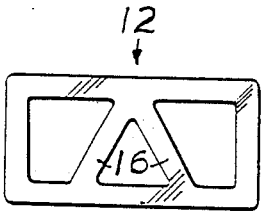
Figure 4:
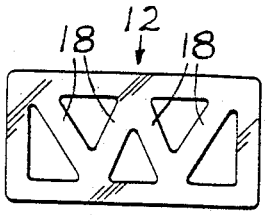

The rectangular profile of the hollow extrusion requires internal structural reinforcement for supporting the heavy weights of wet wood products. Typical forms of internal reinforcements are illustrated in FIGS. 2, 3 and 4. Thus, in FIG. 2 a pair of reinforcing webs 14 extend between the upper and lower walls, being spaced apart laterally from each other and from the side walls.

In FIG. 3 a pair of reinforcing webs 16 diverge downwardly from the centerline of the upper wall to laterally spaced positions at the lower wall. In the preferred embodiment illustrated in FIG. 3, the portion of the bottom wall joining the diverging ends of the webs 16 form with the latter an equilateral triangle.

In FIG. 4 of the drawings the internal reinforcement is provided by a plurality of webs 18 which extend between the top and bottom walls, with adjacent webs diverging from each other to form a truss-like structural reinforcement.

The sticker of this invention preferably is formed by the economical and large scale extrusion of glass fiber-reinforced synthetic thermoplastic resin, utilizing conventional plastic extrusion equipment. The use of thermoplastic resin also afords the economy of reprocessing of stickers that have become broken or otherwise damaged. However, the sticker also is capable of being produced by the pultrusion of glass fiber-reinforced synthetic resins of either the thermoplastic or the thermosetting types.

The foregoing and other modifications and changes in the types and admixtures of materials as well as the dimensions and shapes described hereinbefore, may be made without departing from the spirit of this invention and the scope of the appended claims.

I claim:

1. A dry kiln wood spacing sticker, comprising an elongated, hollow, internally reinforced, extruded rectangular profile of synthetic resin reinforced with about 20–40% by weight glass fiber, the rectangular profile having a peripheral wall thickness ranging between about 0.0625 inch and 0.125 inch.

2. The dry kiln wood spacing sticker of claim 1 wherein the synthetic resin is polycarbonate resin.

3. The dry kiln wood spacing sticker of claim 1 wherein the synthetic resin comprises a mixture of polycarbonate resin and polysulfone resin.

4. The dry kiln wood spacing sticker of claim 3 wherein the glass fiber-reinforced synthetic resin mixture includes about 35% by weight polycarbonate resin, about 35% by weight polysulfone resin and about 30% by weight glass fiber.

5. The dry kiln wood spacing sticker of claim 1 wherein the external width ofthe rectangular profile ranges between about 1 inch and 3 inches and the external height ranges between about 0.25 inch and 1.25 inches.

6. The dry kiln wood spacing sticker of claim 1 wherein the external width of the rectangular profile is about 1.5 inches and the external height ranges between about 0.625 inch and 1 inch.

7. The dry kiln wood spacing sticker of claim 1 wherein the internal reinforcement comprises at least one web interconnecting the top and bottom peripheral walls inwardly of the side walls.

8. The dry kiln wood spacing sticker of claim 1 wherein the internal reinforcement comprises a plurality of webs interconnecting the top and botton peripheral walls and are spaced laterally from each other and from the side walls and extend parallel to the side walls.

9. The dry kiln wood spacing sticker of claim 1 wherein the internal reinforcement comprises a plurality of webs adjacent ones of which diverge from each other and extend between the top and bottom peripheral walls of the rectangular profile.

* * * * *